US007600590B2

(12) United States Patent
Felderhoff et al.

(10) Patent No.: US 7,600,590 B2
(45) Date of Patent: Oct. 13, 2009

(54) LOW PROJECTION INSERTS FOR ROCK BITS

(75) Inventors: Floyd C. Felderhoff, Montgomery, TX (US); Brian A. Baker, Shenandoah, TX (US); Rudolf C. Pessier, The Woodlands, TX (US); Jimmy W. Eason, The Woodlands, TX (US)

(73) Assignee: Baker Hughes Incorporated, Houston, TX (US)

( * ) Notice: Subject to any disclaimer, the term of this patent is extended or adjusted under 35 U.S.C. 154(b) by 198 days.

(21) Appl. No.: 11/204,063

(22) Filed: Aug. 15, 2005

(65) Prior Publication Data

US 2007/0034415 A1 Feb. 15, 2007

(51) Int. Cl.
*E21B 10/16* (2006.01)

(52) U.S. Cl. ..... 175/432; 175/431

(58) Field of Classification Search ..... 175/432, 175/431

See application file for complete search history.

(56) References Cited

U.S. PATENT DOCUMENTS

| | | | | | |
|---|---|---|---|---|---|
| 2,774,570 | A * | 12/1956 | Cunningham | ..... | 175/374 |
| 2,774,571 | A * | 12/1956 | Morlan | ..... | 175/341 |
| 3,127,067 | A | 3/1964 | Hall et al. | | |
| 3,495,668 | A | 2/1970 | Schumacher | | |
| 3,952,815 | A | 4/1976 | Dysart | | |
| 4,940,099 | A | 7/1990 | Deane et al. | | |
| 5,351,768 | A | 10/1994 | Scott et al. | | |
| 5,351,770 | A * | 10/1994 | Cawthorne et al. | ..... | 175/374 |
| 5,655,612 | A | 8/1997 | Grimes et al. | | |
| 5,881,829 | A * | 3/1999 | Dimond et al. | ..... | 175/378 |
| 6,116,359 | A | 9/2000 | Prejean | | |
| 6,561,292 | B1 * | 5/2003 | Portwood | ..... | 175/376 |
| 7,096,981 | B2 * | 8/2006 | Van Klompenburg et al. | ..... | 175/378 |
| 2004/0084222 | A1 * | 5/2004 | Klompenburg et al. | ..... | 175/331 |
| 2004/0173384 | A1 | 9/2004 | Yong et al. | | |
| 2005/0257963 | A1 | 11/2005 | Tucker et al. | | |
| 2006/0260846 | A1 * | 11/2006 | Portwood et al. | ..... | 175/331 |

FOREIGN PATENT DOCUMENTS

| | | |
|---|---|---|
| GB | 2324554 | 10/1998 |
| GB | 2368601 | 5/2002 |

OTHER PUBLICATIONS

Hughes Christensen, "Drill Bit Catalog", 2004, 56 pages.*

* cited by examiner

*Primary Examiner*—Jennifer H Gay
*Assistant Examiner*—David Andrews
(74) *Attorney, Agent, or Firm*—Bracewell & Giuliani LLP

(57) ABSTRACT

An earth boring bit has an outer row of inserts located within extra deep holes. Each of the holes has a cylindrical sidewall with a depth greater than the length of the barrel of the insert mounted within. The difference in depth is at least equal to a distorted entry zone in the hole. A portion of the sidewall that includes the entry zone surrounds the cutting end, reducing the projection of the cutting end from the land.

17 Claims, 3 Drawing Sheets

LOW PROJECTION INSERTS FOR ROCK BITS

FIELD OF THE INVENTION

This invention relates in general to rolling cone earth boring bits, and in particular to cones having some of the inserts mounted with recessed cutting ends.

BACKGROUND OF THE INVENTION

One type of earth boring bit has cones that rotate as the bit revolves around a bit axis. Each cone has a number of rows of cutting elements. In one type, the cutting elements comprise tungsten carbide inserts pressed within holes formed in the exterior surface of the cones. Each insert has a cylindrical barrel that fits in an interference fit in one of the holes. A cutting end or tip is integrally formed with the barrel and protrudes from the hole. The cutting tip may be of a variety of configurations, such as hemispherical, ovoid, or chisel-shaped.

Typically, in the prior art, the holes are drilled in annular lands formed on the exterior of the cone. The land is normally cylindrical or conical. The depth of the hole sidewall normally equals the length of the barrel. The land is thus flush with the junction between the barrel and the cutting tip. The entire cutting tip protrudes from the land.

In some bit cones, part of the holes may be drilled into individual spaced apart circular counterbores, rather than an annular land. In those cases, the sidewall of the hole has a depth, measured from the base of the counterbore, that equals the length of the barrel. The junction of the barrel with the cutting end is flush with the base of the counterbore.

A number of years ago, reduced projection inserts were used in the nose and inner rows of some bits manufactured by the assignee of this invention, particularly for hard formations. In those bits, the junction between the barrel and the cutting end of the reduced projection inserts was recessed in the hole. The depth of the hole sidewall was approximately 0.060 inch greater than the length of the barrel. As a result, only a portion of the cutting end protruded past the land. The recession was done to reduce the risk of coring due to lost inserts in the nose area. To the inventors' knowledge, inserts with recessed cutting tips were not located in the outer or heel row or the adjacent row in those bits. The design of recessing the cutting tips of the inserts in the nose and inner rows of certain bits was discontinued several years ago by the assignee of this application.

The outer row inserts encounter the most severe conditions during drilling. These inserts are more subject to breakage due to high bending forces imposed on the inserts. Inserts are made less resistant to breakage by increasing the toughness, but this decreases the hardness. A decreased hardness generally results in the insert wearing faster in hard formations. Also, outer row inserts are made more resistant to breakage by having a shorter cutting tip, which reduces the moment arm on the insert. However, in the prior art, it has been generally considered that reduced insert projection reduces the rate of penetration. Also, the loss of inserts, even with a shorter cutting tip, still occurs.

SUMMARY OF THE INVENTION

In this invention, the cutting ends of outer row inserts are recessed in holes deeper than the barrel lengths. Each hole has a cylindrical sidewall with a substantially constant diameter. The sidewall has a depth that is greater than a length of the barrel of the insert.

During the press-fit procedure, an entry portion of the hole is distorted. The distorted entry zone is slightly enlarged relative to the remainder of the hole. As a result, the distorted entry zone provides less gripping force than the remainder of the hole. In this invention, at least a majority of the distorted entry zone is above the barrel and encircles part of the cutting tip. As a result, the barrel experiences the full designed gripping force throughout its length. Inspections have determined that the entry zone is typically about 0.080 inch in depth. Preferably, the minimum difference between the barrel length and the sidewall depth is 0.080 inch.

The holes for the outer row may be drilled in an annular land that has a tapered outer edge. If so, at the outer edge, the sidewall depth is less than at the inner edge, 180 degrees thereform. The sidewall depth of the hole at the outer edge should be greater than the length of the barrel and is preferably greater than the depth of the distorted entry zone, so that the barrel is not in contact with any part of the distorted entry zone. In one embodiment, the sidewall depth at the minimum depth point at the outer tapered edge of the land is 0.080 inch greater than a length of the barrel. Preferably, inserts are mounted in holes for the adjacent row in the same manner. Inserts for some of the inner rows may also be mounted in the same manner.

DETAILED DESCRIPTION OF THE INVENTION

Figure 1:
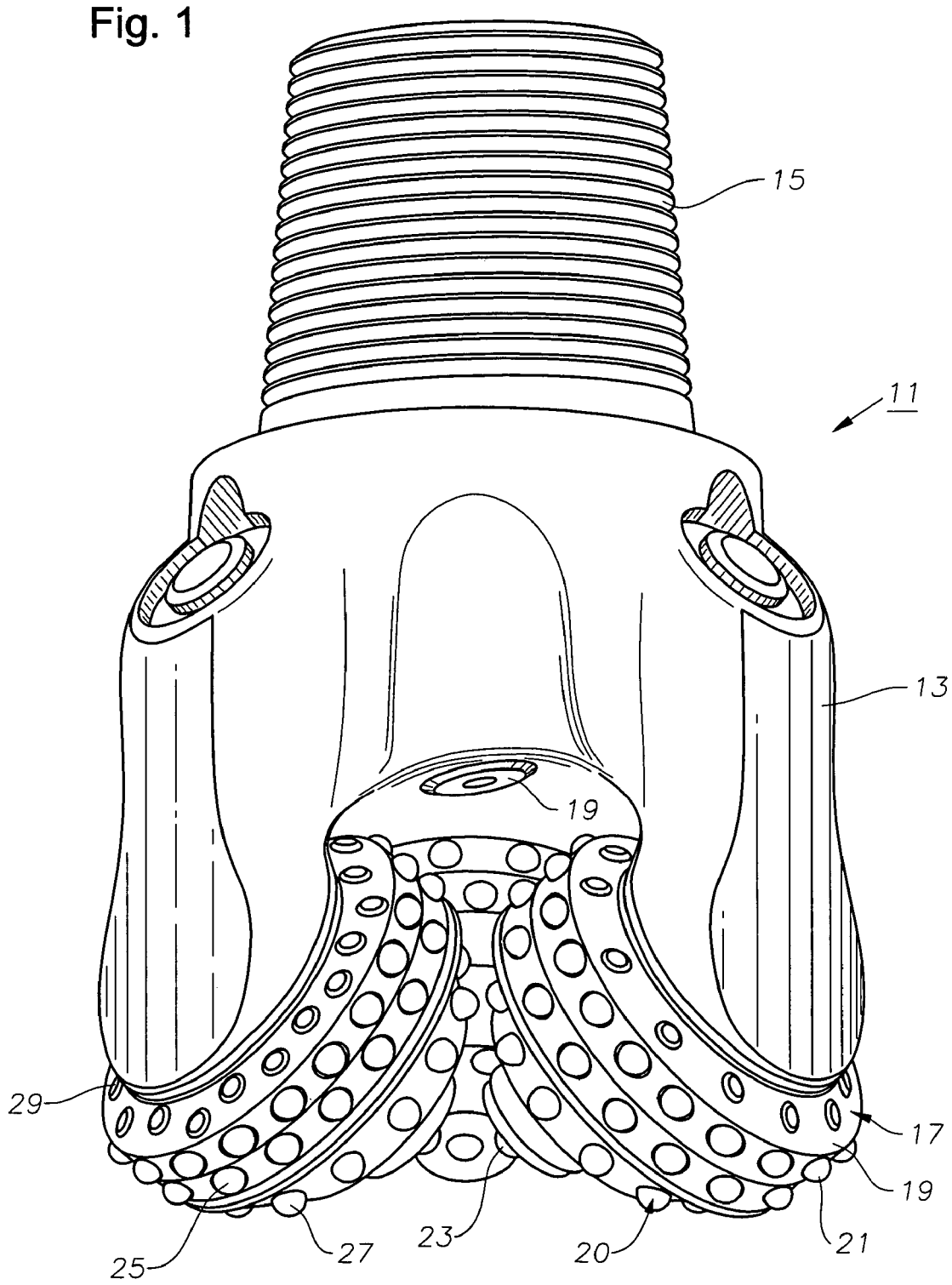
FIG. 1 is a side elevational view of a bit constructed in accordance with this invention, and showing the rows of inserts in a generally schematic manner.

Referring to FIG. 1, bit 11 has a body 13 with a threaded pin 15 on the upper end for connection to a drill string. At least one cone, and typically three cones 17, are rotatably mounted on bearing pins (not shown) that extend from bit legs of body 13.

Each cone 17 has a generally conical exterior with a gage surface 19 on its outer end and a nose area 23 on its inner end. A plurality of inserts 20, shown schematically in FIG. 1, are mounted and protrude from the exterior surface of each cone 17. Each cone 17 has an outer or heel row 21 of inserts 20, an adjacent row 25 of inserts 20 located next to outer row 21, and one or more inserts 20 in the nose area 23. In this embodiment, each cone 17 also has an inner row 27 located between nose area 23 and adjacent row 25. Gage inserts 29, each having a flat top, are mounted to gage surface 19.

Figure 2:
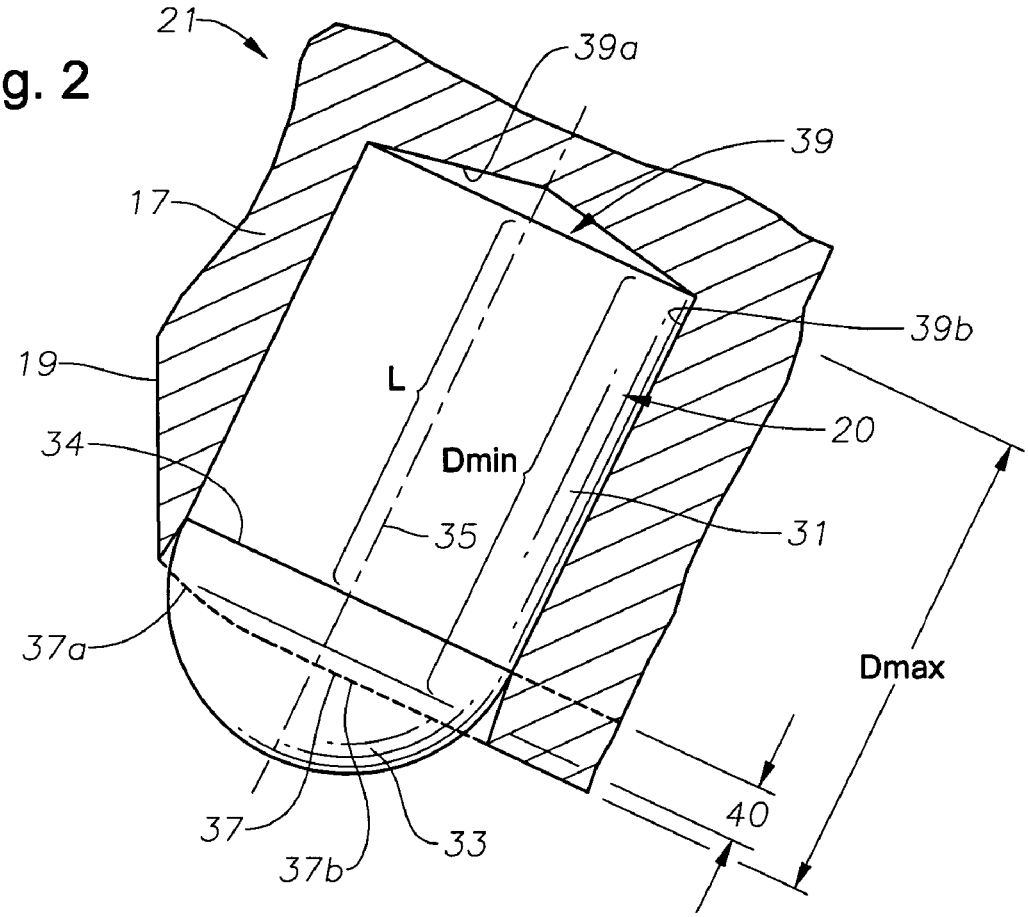
FIG. 2 is an enlarged sectional view of one of the cones of the bit of FIG. 1, showing an outer row insert.

Referring to FIG. 2, each insert 20, regardless of where it is located, has a cylindrical barrel 31 and an integral cutting tip or end 33 that joins and protrudes from barrel 31. Cutting end 33 may have a variety of configurations, including hemispherical, ovoid, chisel-shaped, or other configurations. In this embodiment, cutting end 33 is illustrated as being hemispherical. A junction plane 34 is located at the junction of cutting end 33 and barrel 31. In this embodiment, junction plane 34 is perpendicular to barrel axis 35. Alternately, cutting end 33 could be canted relative to barrel 31, in which case its axis would intersect barrel axis 35 at an acute angle.

FIG. 2 illustrates an insert 20 of outer row 21, which is located on an outer or heel row land 37. Land 37 is an annular surface that extends around the exterior of cone 17 and is generally conical. When viewed in the transverse cross-section of FIG. 2, land 37 of this embodiment has a flat inner portion 37*b* that is perpendicular to barrel axis 35, but it could be convex. An outer portion 37*a* of land 37 joins gage surface 19 and tapers at a different inclination from inner portion 37*b*. The taper of land outer portion 37*a* may be a curved radius in a transverse cross-section shown in FIG. 2, or it may be a flat conical section at a different inclination than inner portion 37*b*. Outer land portion 37*a* in this example has a lesser width than inner land portion 37*b*.

Insert 20 is mounted within a hole 39 that is drilled into the body of cone 17 through land 37. In the preferred embodiment, hole 39 is normal or perpendicular to inner portion 37*b* of land 37, although it could incline, if desired. Hole 39 has a bottom 39*a* that is normally conical as a result of the point of the drilling tool used to form hole 39, or it may be flat. Hole 39 has a cylindrical sidewall 39*b* with a depth measured from its intersection with bottom 39*a* to land 37. In the example of FIG. 2, sidewall 39*b* has a minimum depth Dmin measured at an outermost point 180 degrees opposite from maximum depth Dmax at its innermost point. The difference in Dmin and Dmax occurs because hole 39 is not normal to the entire land 37, rather hole 39 is normal only to land inner portion 37*b*, not land outer portion 39*a*. Ideally, Dmin and Dmax are equal, but in this example, a gradual contour of land 37 to gage surface 19 was desired.

Prior to installing insert 20, the diameter of hole sidewall 39*b* is initially the same measured from its bottom edge to land 37, within conventional manufacturing tolerances. This initial diameter is slightly smaller than the outer diameter of barrel 31 to create an interference fit. During the press fit procedure, insert 20 is pushed into hole 39 with a high force. Inspection has shown that an entry portion 40 of sidewall 39*b* becomes slightly permanently distorted. Entry portion 40 flares out and becomes slightly enlarged in diameter relative to the remaining portion. The amount of outward deflection is slight, thus the diameter of hole 39 still is considered constant from the bottom edge of sidewall 39*b* to land 37. Nevertheless, it has been found that entry portion 40 fails to grip insert 20 as adequately as the remaining portion of sidewall 39*b*. The portions of sidewall 39*b* below entry portion 40 are only elastically deformed, thus provide a desired confining stress to barrel 31. In the prior art, the permanent deformation of entry portion 40 may still be in contact with barrel 31, but does not provide adequate confining stress because it is permanently deformed.

The depth of entry portion 40 along sidewall 39*b* can be predicted by finite element analysis or physically observed by laboratory instruments by removing previously installed inserts 20 before the bit is run. Inspections have shown that distorted entry portion 40 normally has an average depth of about 0.080 inch, although variations do occur, of course. The depth of entry portion 40 does not appear to be dependent on the diameter or depth of sidewall 39*b*.

In this invention, hole 39 is drilled deeper than in the prior art to preferably assure that substantially the entire entry portion 40 is entirely above barrel 31. Barrel 31 is thus preferably entirely retained within a portion of hole 39 that has only undergone elastic deformation. The minimum sidewall 39*b* depth Dmin is made greater than the length L of barrel 31, preferably by at least the average depth of distorted portion 40, which has been found to be about 0.80 inch. The depth Dmax at the innermost point is even greater than barrel length L. A portion of hole sidewall 39*b* thus completely encircles cutting end 33.

Cutting end 33 protrudes past land 37 at all points, even where sidewall 39*b* has its maximum depth Dmax. The amount of protrusion of cutting end 33 depends on a number of factors, such as the drilling rotation speed and the type of earth formation being drilled. Generally, in very hard formations, the amount of penetration of the bit into the borehole bottom is only about 0.050 inch or less per revolution. For the heel row 21, the penetration is even less because three redundant rows cover that portion of the borehole bottom. If bit 11 is to be used in such a formation, the difference between sidewall maximum depth Dmax and barrel lengh L should be limited to result in cutting end 33 protruding past land 37 at least 0.050 inch at any point.

Figure 3:
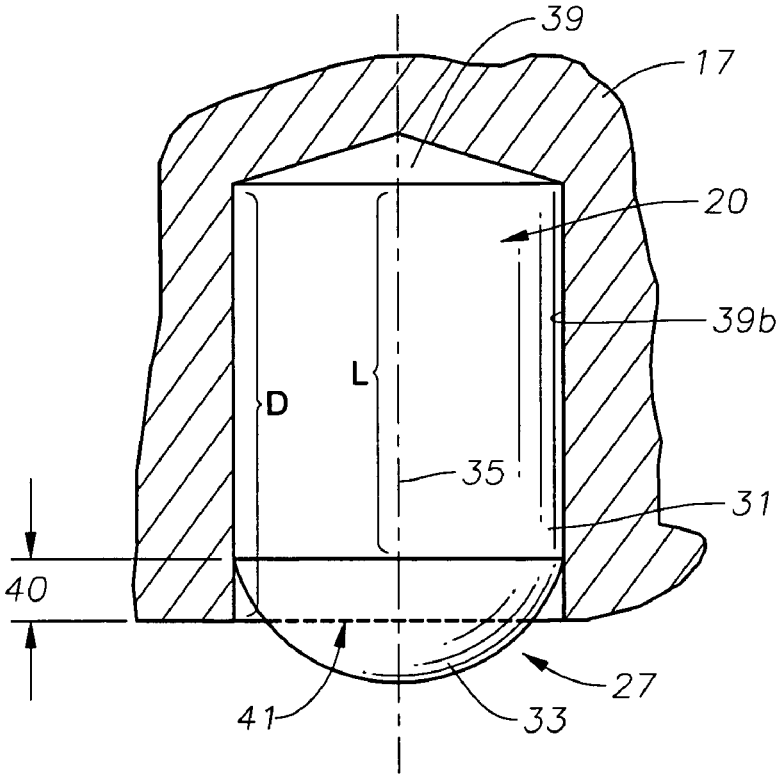
FIG. 3 is an enlarged sectional view of one of the cones of the bit of FIG. 1, showing an inner row insert.

Referring to FIG. 3, an inner row 27 is shown. Insert 20 of inner row 27 is mounted within hole 39 in the same manner as in FIG. 2. Hole 39 is formed in an inner row land 41. In this example, inner row land 41 has a single conical angle or flat portion that is greater than the diameter of hole 39. Any tapered or contoured portions of land 41 are either on the inner side of of or outer side of the intersection of hole 39 with land 41. The depth D of hole sidewall 39*b* is thus constant. Entry portion 40 is preferably substantially above barrel 31, so that substantially no portion of barrel 31 remains in contact with entry portion 40.

Figure 4:
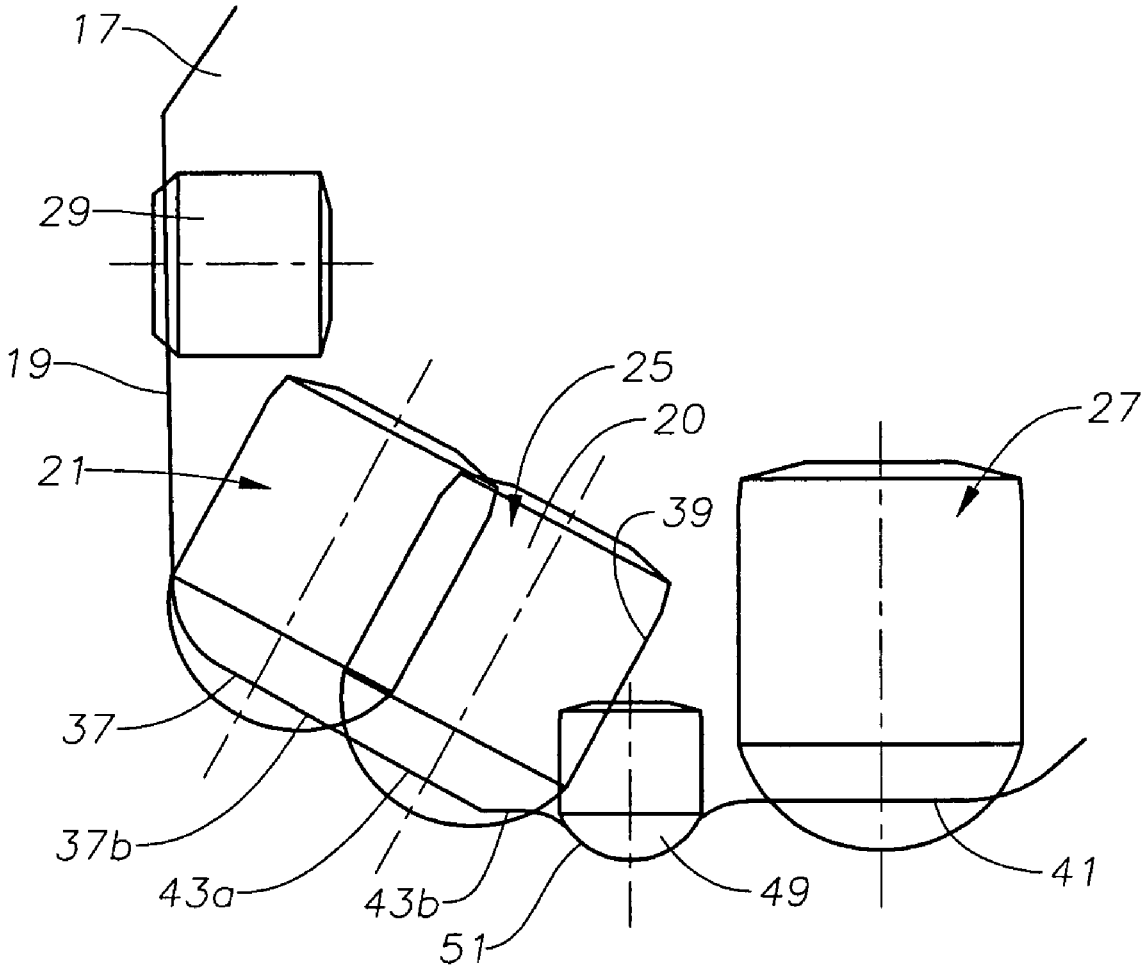
FIG. 4 is a sectional view of one of the cones of the bit of FIG. 1, showing the inserts of FIGS. 2 and 3 as well as other inserts.

Referring to FIG. 4, in addition to outer row 21 and inner row 27, an adjacent row 25 is shown. In the example shown in FIG. 4, adjacent row 25 is staggered relative to outer row 21. That is, each insert 20 of adjacent row 25 is partially located between two inserts 20 of outer row 21, but adjacent row 25 could be spaced farther inward, if desired, so that no overlap occurred. Hole 39 for adjacent row 25 is formed in the same manner as the embodiments in FIGS. 2 and 3. Hole 39 is drilled into an adjacent row land portion 43*a* that joins and is at the same conical angle as outer row land portion 37*b*. The adjacent row land has a tapered inner section 43*b*, in this example, that inclines relative to outer portion 43*a*. Hole 39 is drilled deeper than the length of the barrel of insert 20 of adjacent row 25 by the same amount as outer row 21 and inner row 27.

FIG. 4 also shows a smaller diameter insert 49 located between adjacent row 25 and inner row 27. Inserts 49 are located in a convex annular land 51. Land 51 has a profile in the cross-section shown in FIG. 4 that is the same profile as the cutting end of insert 49. Because inserts 49 do not protrude past land 51 during normal use, they provide no cutting action during normal use, rather serve to prevent erosion of the cone 17 metal.

The invention has significant advantages. The deeper hole provides increased retention by positioning substantially all of the deformed entry portion around the cutting end, rather than around any portion of the barrel. The deformed entry portion provides additional support to the cutting end by serving as a buffer to reduce the load and impact forces on the insert. The reduced projection of the cutting end does not diminish the rate of penetration yet reduces breakage. The reduced projection allows a harder or more wear resistant grade of carbide to be used for the inserts due to better confining stress around the entire barrel section of the insert.

While the invention has been shown in only one of its forms, it should be apparent to those skilled in the art that it is not so limited but is susceptible to various changes without departing from the scope of the invention. For example, it may be useful in some applications to have conventional depth holes for the outer row and reduced projection inserts in the adjacent row.

The invention claimed is:

1. An earth boring bit having at least one rotatable cone, comprising:

an outer row of inserts mounted in an interference fit within holes formed in an outer annular land bordering a gage surface of the cone;

each of the inserts having a cylindrical barrel and a cutting end protruding therefrom;

each of the holes having a cylindrical sidewall, the sidewall having a minimum depth measured at all points around a circumference of the hole that is greater than a length of the barrel of the insert mounted therein; wherein an intersection of the cutting end with the barrel is recessed a selected distance within the hole such that the sidewall completely surrounds the intersection; and the minimum depth of the sidewall is about 0.080 inch or more greater than the length of the barrel of each of the inserts.

2. The bit according to claim 1, wherein each of the holes has a distorted entry zone extending from a surface of the cone completely around the circumference of the hole, and wherein substantially the entire entry zone is located above the barrel.

3. The bit according to claim 1, wherein:

each of the holes has a distorted entry zone extending downward from a surface of the cone completely around a circumference of the hole; and the entry zone has a depth that is less than the difference between the minimum depth of the sidewall and the length of the barrel of the insert mounted therein.

4. The bit according to claim 1, wherein the depth of the sidewall is measured from a bottom edge of the sidewall to the annular land.

5. The bit according to claim 1, wherein an axis of the hole is normal to an inner portion of the annular land.

6. The bit according to claim 1, further comprising:

an adjacent row of inserts mounted in holes formed inward and next to the outer row of inserts;

each of the adjacent row inserts having a cylindrical barrel and a cutting end protruding therefrom;

each of the holes for the adjacent row inserts having a cylindrical sidewall, the sidewall of each hole for the adjacent row inserts having a minimum depth measured at all points around a circumference of the hole that is greater than a length of the barrel of the adjacent row insert mounted therein, such that an upper portion of the sidewall completely surrounds a lower portion of the cutting end.

7. The bit according to claim 1, wherein the barrel of each of the inserts has an axis, and the cutting end of each of the inserts has an axis that coincides with the axis of the barrel.

8. An earth boring bit having at least one rotatable cone, comprising:

an outer row of inserts mounted in an interference fit within holes formed adjacent a gage surface of the cone;

each of the inserts having a cylindrical barrel and a cutting end protruding therefrom;

each of the holes having a cylindrical sidewall, the sidewall having a minimum depth that is greater than a length of the barrel of the insert mounted therein;

an annular land is formed adjacent the gage surface, the outer row of inserts being located on the annular land;

the annular land has a transverse cross-section containing an inner portion and an outer tapered portion that is inclined relative to the inner portion; and the minimum depth of the sidewall is located at the intersection of the. hole with the outer tapered portion.

9. An earth boring bit having at least one rotatable cone, comprising:

an outer row land adjoining a gage surface;

a plurality of outer row inserts protruding from the outer row land;

an adjacent row land adjoining the outer row land;

a plurality of adjacent row holes formed in and oriented normal to the adjacent row land;

a plurality of adjacent row inserts mounted in an interference fit within the adjacent row holes in the adjacent row land;

each of the adjacent row inserts having a cylindrical barrel and a cutting end protruding therefrom, wherein a plane at a junction of the barrel and the cutting end is perpendicular to an axis of the barrel; and each of the adjacent row holes having a cylindrical sidewall with a substantially constant diameter from a bottom edge of the hole to the land, the sidewall having a depth measured at all points around a circumference of the sidewall that is about 0.080 inch or more greater than a length of the barrel of the adjacent row insert mounted therein.

10. The bit according to claim 9, wherein the depth of the sidewall of each of the holes at an outermost point is greater than a depth of the sidewall at an innermost point.

11. The bit according to claim 9, wherein:

the adjacent row land has a transverse cross-section containing an inner portion and an outer portion that is inclined relative to the inner portion; and each of the adjacent row holes has an axis that is normal to the outer portion.

12. The bit according to claim 9, wherein:

each of the outer row inserts has a cylindrical barrel and a cutting end protruding therefrom; and each of outer row inserts is mounted in an outer row hole having a cylindrical sidewall with a substantially constant diameter, the sidewall of each outer row hole having a depth measured at all points around a circumference of the outer row hole that is about 0.080 inch or more greater than a length of the barrel of the outer row insert mounted therein.

13. An earth boring bit having at least one cone, the cone having a nose area and a gage surface, comprising:

at least one annular land formed on an exterior surface of the cone between the nose area and the gage surface, the annular land having a plurality of holes formed therein, each of the holes having a cylindrical sidewall with a constant diameter. from a bottom edge of the sidewall to the annular land;

a plurality of inserts. each of the inserts having a cylindrical barrel and a cutting end protruding therefrom, each of the inserts being pressed into one of the holes in an interference fit, creating a distorted entry zone in the sidewall;

each of the sidewalls having a minimum depth measured at all points around its circumference that is sufficiently greater than a length of the barrel to place substantially the entire barrel below the distorted entry zone;

wherein a lower portion of the cutting end is completely surrounded by an upper portion of the hole in which it is mounted: and wherein the minimum depth of each of the sidewalls is at least 0.080 inch greater than the length of the barrel.

14. The bit according to claim 13, wherein the depth of each of the sidewalls is substantially constant measured at any circumferential point along each of the sidewalls.

15. The bit according to claim 13, wherein said at least one annular land borders the gage surface of the cone.

16. The bit according to claim 13, wherein:

the annular land has an inner portion and an outer portion, the outer portion being at a different inclination relative to the inner portion;

the hole intersects both the inner portion and the outer portion of the land; and the minimum depth of the sidewall is located at the intersection of the hole with the outer portion.

17. The bit according to claim 13, wherein the barrel of each of the inserts has an axis, and the cuffing end of each of the inserts has an axis that coincides with the axis of the barrel.

* * * * *